United States Patent [19]

Vickery

[11] Patent Number: 4,470,168

[45] Date of Patent: Sep. 11, 1984

[54] CHIMNEY CLEANING APPARATUS AND METHOD OF MAKING SAME

[76] Inventor: Donald P. Vickery, 18 Easterly St., Gloversville, N.Y. 12084

[21] Appl. No.: 368,577

[22] Filed: Apr. 15, 1982

[51] Int. Cl.[3] ..... F23J 3/00

[52] U.S. Cl. ..... 15/163; 15/243; 300/21; 134/8

[58] Field of Search ..... 15/DIG. 3, 162, 163, 15/242, 243, 249, 104.16, 104.2; 264/239, 243; 300/21

[56] References Cited

U.S. PATENT DOCUMENTS

| | | | |
|---|---|---|---|
| 272,437 | 2/1883 | Higgins | 15/242 X |
| 363,893 | 5/1887 | Harvey | 15/163 |
| 410,479 | 9/1889 | Ahern | 15/104.2 |
| 739,435 | 9/1903 | Melcher | 15/249 |
| 1,545,355 | 7/1925 | Roth . | |
| 2,072,110 | 3/1937 | Jennings | 300/21 |
| 2,215,514 | 9/1940 | MacGregor | 15/104.2 X |
| 4,028,769 | 6/1977 | Coviello et al. | 15/249 |
| 4,085,477 | 4/1978 | Anderson | 15/243 |
| 4,208,757 | 6/1980 | Baugh et al. | 15/249 |
| 4,261,073 | 4/1981 | Lane | 15/163 |

FOREIGN PATENT DOCUMENTS

| | | | |
|---|---|---|---|
| 468876 | 5/1914 | France | 15/243 |

*Primary Examiner*—Peter Feldman
*Attorney, Agent, or Firm*—Heslin & Watts

[57] ABSTRACT

Hard, brittle creosote deposits are removed from a chimney flue by striking the sharp ends of rods of flue cleaning apparatus against the deposits with penetrating impact and creosote chip-producing effect so as to break away creosote adhering to the flue.

13 Claims, 14 Drawing Figures

CHIMNEY CLEANING APPARATUS AND METHOD OF MAKING SAME

FIELD OF THE INVENTION

This invention relates to the chimney cleaning art and is more particularly concerned with a novel method of removing adherent deposits of hard and brittle creosote from chimney flues, with new apparatus implementing that method and with a unique method of making such apparatus.

BACKGROUND OF THE INVENTION

Each year there are thousands of chimney fires with the major cause of these dangerous chimney fires being the accumulation of creosote in chimney flues. Airtight stoves are heavy producers of creosote which, in the form of a gas, rises up the chimney and condenses on the flue at the point at which it has cooled to the 255° F. temperature range. Such creosote condensate coats the flue with deposits of different consistencies from liquid to a hard, brittle glaze which do not usually block the flue but result in the flue opening or aperture becoming smaller. In a chimney fire, such hard creosote deposits burn and expand to a light-weight, crusty material two to three times original volume to block the flue partially or totally, or such crusty material is dislodged and falls away from the flue and then lodges and blocks the flue at a lower point.

Brushing is not an answer to this problem as it serves not to remove these hard deposits of creosote but only to expose them by removal of soot and other nonflammable deposits which actually enhances their exposure to heat and oxygen. Thus, many chimney fires have occurred soon after brushing.

Despite long-standing general recognition of this hazard and its source, it was only recently that means operable from a location outside a chimney were provided which enabled effective removal of hard and brittle creosote deposits from the chimney flue. Thus, novel devices of my invention disclosed and claimed in co-pending patent application, Ser. No. 282,968, filed July 13, 1981 serve the purpose and have the additional advantage that they can be used to unblock a chimney while in use or even during a chimney fire. Further, these devices are so designed and constructed that the operator can position himself away from the chimney and out of harm's way as he uses these devices to clear chimneys in use or on fire. In one embodiment of that invention, the creosote deposits are effectively hammered out sufficiently to open the flue passage by repeatedly dropping a weighted cutter assembly down the chimney and raising it up again so that the cutters ram, break and clear away portions of the deposits projecting into the central portion of the flue passageway. In another embodiment, an articulated spring steel pick assembly is carried freely on a cylindrical impacting weight in a manner such that when the cleaning head is repeatedly dropped and raised in the chimney, the deposits are impacted, broken and cleared in generally the manner described above and in addition the articulated steel picks intermittently brush and pick away at and dislodge the deposits as the assembly is caused to rotate in a counter-clockwise manner because of the orientation and form of the articulated spring steel picks.

SUMMARY OF THE INVENTION

In contrast to the devices of my aforesaid invention, those of my present invention do not operate either as a hammer or as a sort of brush. Instead, the device of this invention operates as an impact drill and with wedging effect as each drill point penetrates a hard creosote deposit and chips it. The hard deposits are thus progressively broken away and diminished in size and this is accomplished as the cleaning device is randomly moved transversely within the flue as it is repeatedly raised and lowered through the section to be cleaned, striking against hard creosote deposits along the way with penetrating impact and chip-producing effect.

It will be understood, therefore, that this invention centers in the novel concept of removing hard creosote deposits from flues by repeatedly driving rods with axially-applied force against the deposits and thereby penetrating the deposits and breaking them. As a practical matter in the best practice of this invention, the penetration is only superficial and the breakage amounts to chipping which results from rod tip wedging or prying action. Thus, removal of the hard creosote accumulation on the surface of a flue in accordance with this invention is characteristically a gradual process in which relatively small chips are produced at random locations but at high rate as the cleaning device implementing this novel concept is continuously moved up and down through the flue section from which creosote is to be removed.

Further, this invention is based upon by discovery that such penetration and chipping effects can be obtained without risk of damage to chimney flue tile. Accordingly, it is another special feature of this invention that the creosote chip-producing rods are of hardness greater than that of the hard creosote, but less than that of the flue tile. In preferred practice, the rods will be 90-mil to 125-mil hardened steel wire of Brinell hardness from 448 to 509 and 230,000 to 250,000 T.S.I. The 90-mil rods are appropriate for use in flue cross sections of relatively small size such as 8 by 8 inches while the 125-mil rods are preferred for larger flues such as 8 by 12 and 12 by 12 inch cross sections.

I have found in addition that a good penetrating effect can be obtain by shearing the rods so as to form sharp, barbed ends. Thus, in assembling a device of this invention with the rods mounted on or in the body of the device and fixed to it, as will be described in detail below, the rods are sized as to length by shearing them so as to afford space for transverse travel for requisite endwise impact on the creosote deposits.

Still further, I have found that clearance of about one-half inch between each end of each rod and the creosote deposit will permit motion of a rod array transversely of the flue sufficient for development of hard creosote-penetrating impact of the rod ends. The space between the rod array and the opposed flue surface is important in terms of effectiveness of creosote removal. In other words, unlike cleaning methods of the prior art, that of this invention does not involve brushing action and consequently each end of each rod or a rod array of this invention is spaced from the flue surface and preferably about one-half inch from the surface of hard creosote deposit on the flue. Greater clearance will not substantially increase the rate of the creosote breakage and removal and may, in fact, diminish it, depending upon the tradeoff between impact frequency on the one hand and rod end penetration depth and chip size on the other.

In the best practice of this invention involving the use of a cleaning head device of this invention comprising a body carrying two spaced apart arrays of creosote chip-producing rods, the body is suspended about one inch off the center or axis of the chimney flue to be cleaned. This will ensure early rod contact with the hard creosote deposit on the flue interior surface and initiation of the transverse motion necessary for the development of hard creosote-penetrating impact of rod ends virtually as soon as vertical travel of the cleaning head is begun. It will be understood, however, that even if the body of the device is disposed coaxially of the chimney flue, the side-to-side rocking motion of the cleaning head will develop when a chip-producing rod strikes against some hard creosote on the flue tile, and once begun, the lateral motion will continue as long as travel of the head up and down the flue is continued.

Since impact force is the product of mass and velocity as represented by the expression $F=MV^2$, and the rods are preferably relatively thin and light, I have found that requisite mass for the purposes of this invention can be provided in the form of an elongated body of concrete or other solid material of similar specific gravity. By using a metal vessel and providing diametrically registered apertures to receive the metal rods, one can assemble the rod arrays and then fill the vessel with cement to bond the vessel and the rods tightly together. By pretreating the metal rods to corrode them superficially, the strength of the cement bonding may be maximized to insure that the device will retain its integrity over prolonged periods of regular use.

I have also discovered that two additional features are essential or strongly preferable in the devices of this invention, both of which contribute importantly to the velocity component of the rod impact force. One of these is the presence of a second rod array spaced from the first and on the opposite side of the neutral axis of the elongated body. Preferably these arrays are adjacent to the ends of the body so that as the rods of one array strike a fixed object in the chimney, the body will swing about its neutral axis and the rods at the other end of the body will be driven against the opposing surface. Consequently, the greater the spacing between the rod arrays, the greater the impact force, but again there is a tradeoff of practical nature as the weight of the body limits the rate at which it can be manually moved up and down in a chimney by a human operator. Another advantage of having the central part of the body free of these rods is that the body has the ability to transverse misaligned tiles of a chimney as illustrated and described in more detail below.

The other of these two features is the suspension of the body and, in fact, this has two aspects. Thus, I have found that the body in better form is tapered and preferably of frustroconical shape but, in any event, should be hung in a flue with the smaller end down. When disposed this way in use, combustion products readily flow continuously up around the device and out of the stack. There is a marked gas flow blocking tendency, however, when the same device is disposed with the large end down in the same chimney. Moreover, I have found that rod transverse velocity is substantially dampened when the larger and heavier end of the device is disposed below the smaller and lighter end.

Further, and even more importantly, I have discovered that the new results and advantages of this invention, and particularly, the unique hard creosote deposit-removing action and effect cannot be consistently obtained if the body of the device is connected by rigid means to a cable or similar lifting means. In particular, it is essential that a flexible member, preferably a spring steel bail, connects the body to the lifting line because, apparently, a substantial component of rod transverse motion velocity derives from the flexible reaction of this connector to the rocking action of the body about its neutral axis.

Briefly described in its method aspect, this invention comprises the steps of introducing into a chimney an array of generally horizontally disposed pointed rods, moving the rod array transversely of the chimney in random manner and intermittently striking rod ends against creosote deposits with penetrating impact and creosote chip-producing effect. While in theory, a single rod might be manipulated and used in that manner, as a practical matter one could only expect to accomplish cleaning effects desired in any reasonable time interval by providing an array of relatively closely-spaced rods.

Likewise, broadly and generally described in its apparatus aspect, the invention takes the form of a cleaning head which comprises an elongated, tapered body, a plurality of metal rods fixed to the body and extending laterally therefrom for creosote deposit-penetrating impact and chip-producing effect and laterally flexible suspension means secured to and extending generally axially from the larger end of the tapered body. It is accordingly apparent that this new apparatus implements the present novel method and thus differs importantly in structure, mode of operation and results, from chimney cleaning devices and apparatus of the prior art.

As another aspect of this invention, this novel apparatus takes the form of an assembly for use in constructing a chimney flue cleaning head, this assembly comprising a hollow frustroconical body having a plurality of diametrically aligned pairs of apertures arranged in two helical patterns near the two ends of the body, a plurality of metal rods for insertion through registered pairs of apertures to project radially from the body, and a spring steel bail having end portions to be received and secured in the body and an intermediate portion to extend from an end of the body for connection to lifting means for the assembled cleaning head.

BRIEF DESCRIPTION OF THE DRAWINGS

The new features and advantages of this invention will be further evident to those skilled in the art from the drawings accompanying and forming a part of this specification, in which.

DETAILED DESCRIPTION OF THE INVENTION

Figure 1:
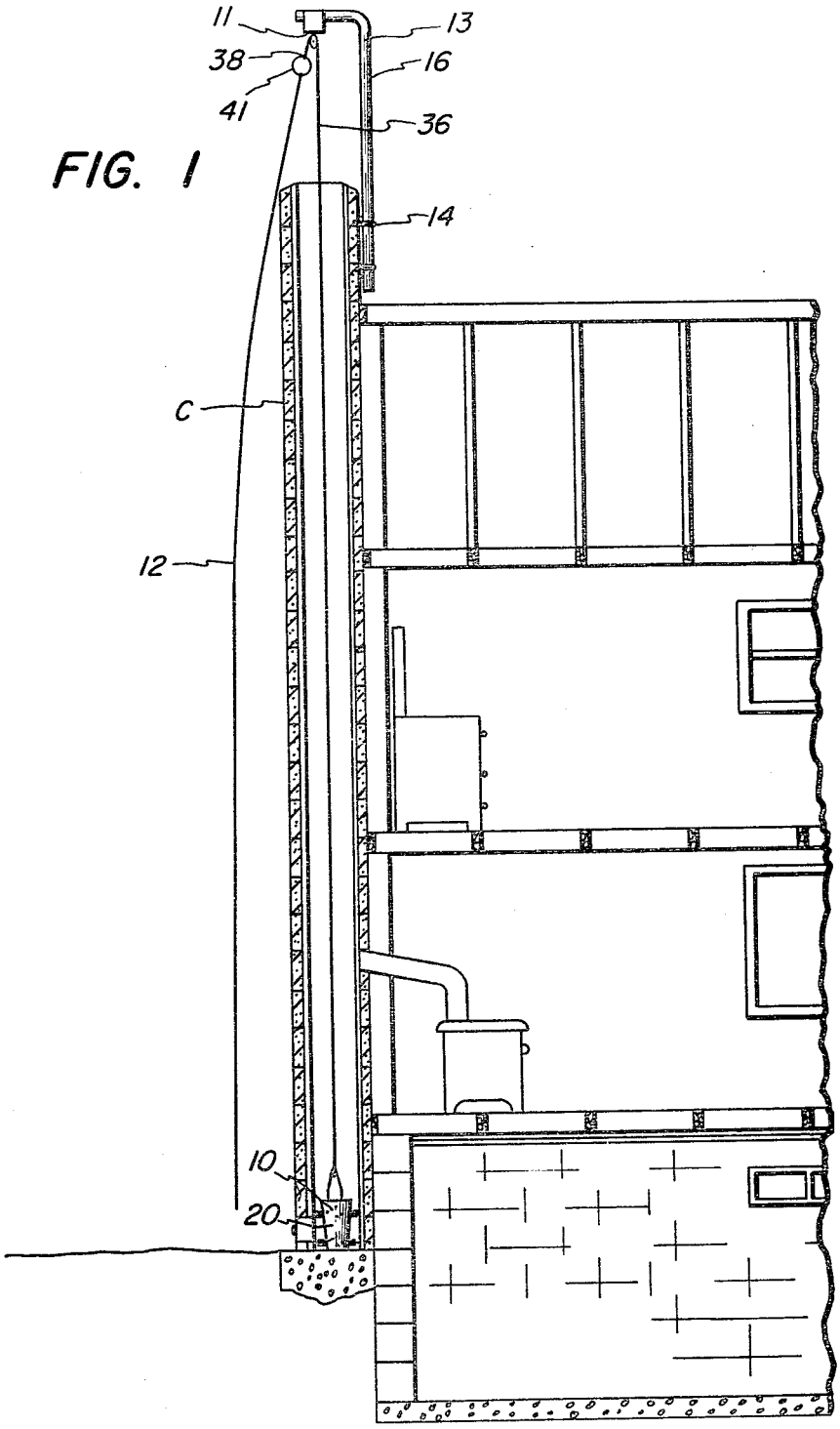
FIG. 1 is a vertical sectional view of part of a typical, two-story, single residence building having a chimney equipped with apparatus of this invention.

The chimney cleaning apparatus illustrated in these drawings represents a preferred embodiment of this invention and its use as described represents my preferred practice of the method of this invention. This apparatus comprises cleaning head 10, sheave 11, line 12, and sheave mounting means 13, including chimney mount frame 14, chimney strap 15 which secures frame 14 to the top of chimney C, and main arm 16 adjustably secured to frame 14 and carrying sheave 11 in fixed position just above the top of the chimney and about one inch off center of the chimney.

Cleaning head 10 comprises an elongated frustroconical body 20 of sheet steel filled with a cured, that is, solid mass 21 of Portland Cement and sand mixture and provided with a spring steel bail 22, ends 23 and 24 of which are embedded in cement mass 21, and two arrays 25 and 26 of steel rods. The rod arrays are located adjacent to the two extremities of body 20 and in each case the array described a 360° helix coaxial of the body, individual rods 25A and 26A all extending diametrically through the body and projecting radially the same length on opposite sides of it. While rod spacing radially and axially of body 20 is not critical within narrow limits, best results are obtained when they are of the order of 7½ to ten or twelve degrees apart and when the axial length of each array is as short as reasonably possible, suitably about two inches, the overall length of the cleaning head being about twelve inches.

Figure 6:
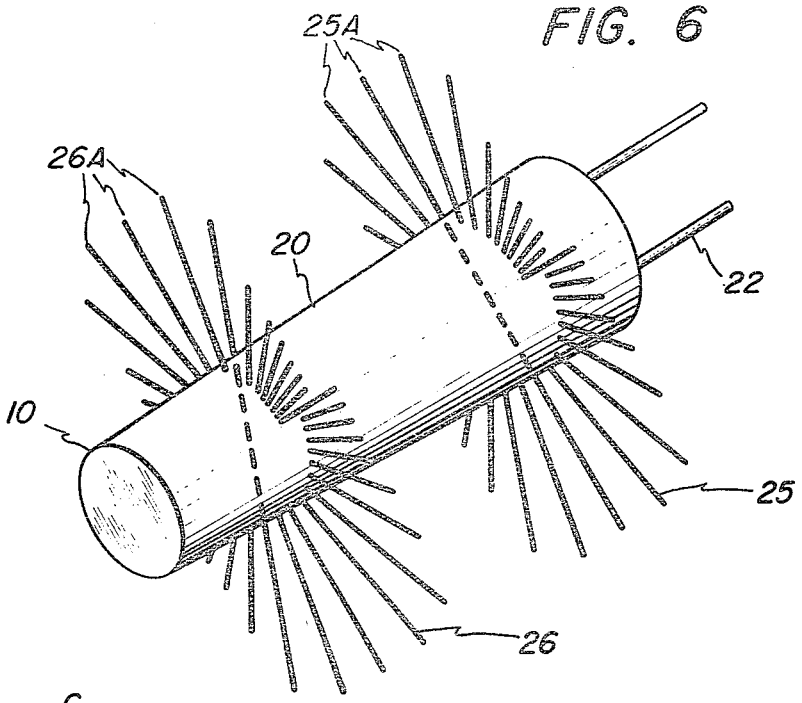
FIG. 6 is an isometric view of the cleaning head of FIG. 4 which shows the different lengths of the metal rods of the rod arrays and the equilateral extension of each rod from the body.

Rods 25A and 26A are of a variety of different lengths so as to describe in plan view (FIG. 6) a rectangular pattern generally the same as that of the flue in which the cleaning head is to be used, but substantially smaller to permit the essential rocking motion of body 20 about its neutral axis described above.

Bail 22 is connected at its apex to line 12 of plastic non-conducting material by means of a cable 36, cable swedge 37 and cable clamp 38. Cable 36 is hung over a sheave 11, carried by sheave stamping 40 secured to and supported by main arm 16 of the sheave mounting assembly. A ring 41 connects line 12 to cable 36 so that as illustrated in FIG. 1, cleaning head 10 can be moved vertically repeatedly through the length of the stack by a person standing near the chimney on the ground without electrical continuity to metal parts of the aperture. Also, sheave 11 is carried by main arm 16 so that cleaning head 10 is normally disposed about one inch off axis of the flue and is not restrained by its suspension means in respect to lateral motion within the chimney.

Figure 2:
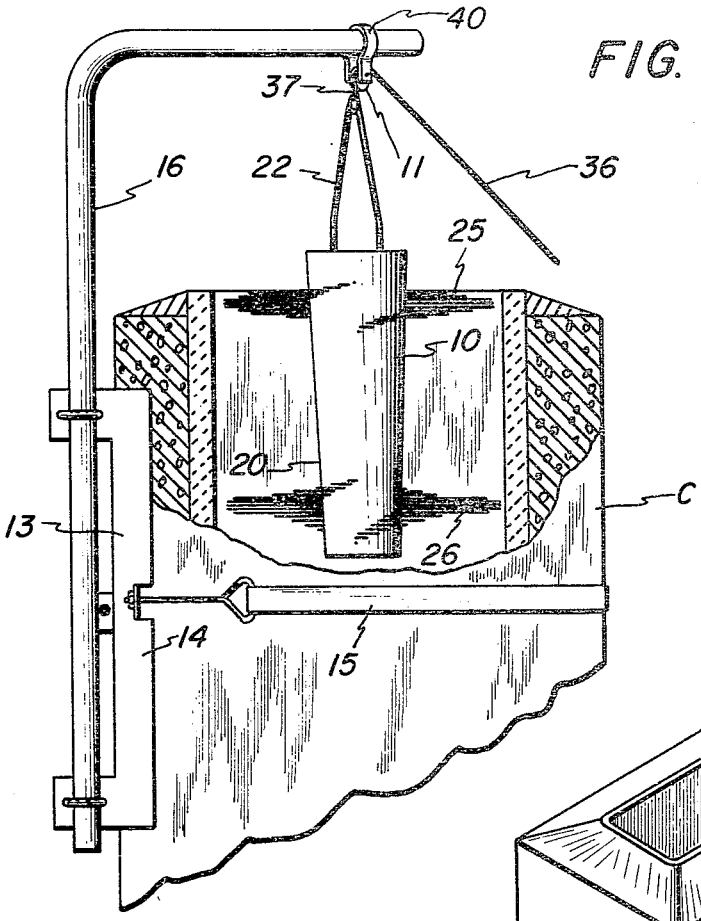
FIG. 2 is a fragmentary, elevational view of the upper end of the FIG. 1 chimney with a portion broken away to show the cleaning head of the apparatus in uppermost position and its associated supporting and operating components in normal assembled relation.
Figure 3:
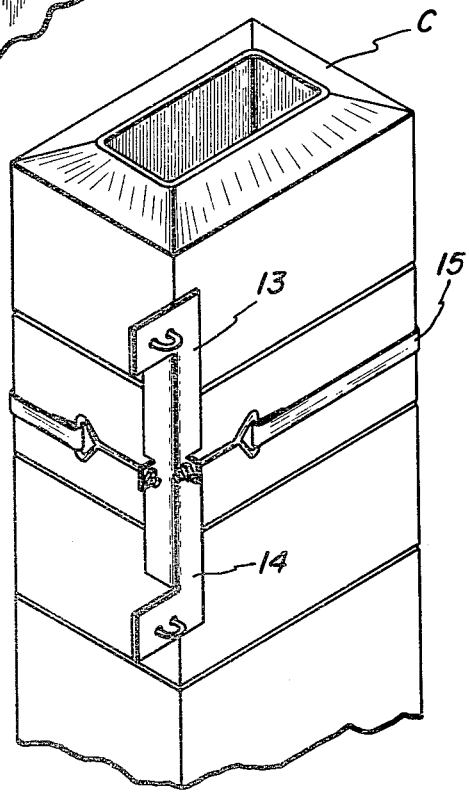
FIG. 3 is a perspective view of the upper end of the chimney of FIG. 1 showing the adjustable bracket of the supporting and operating means for the cleaning head and the manner of attachment of the bracket to the chimney.
Figure 4:
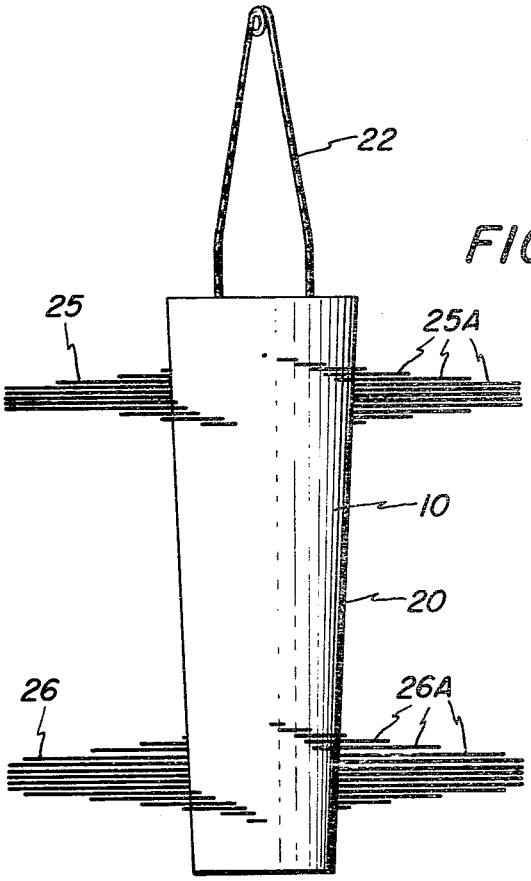
FIG. 4 is a view in side elevation of a preferred form of cleaning head of this invention.

If in accordance with the best practice of this invention, a chimney is well maintained in respect to limitation of hard creosote accumulations, the cleaning head will function with maximum efficiency, lateral clearance affording opportunity for development of maximum rod impact against and penetration of hard creosote deposits. But while greater build-up of those deposits initially restricts lateral motion of the head, the same ultimate cleaning result can be obtained because lateral motion-limiting hard creosote is progressively chipped away as the cleaning head is run up and down the flue. It will be understood further that if very heavy build-up occurs between cleaning operations and a chimney fire results, this apparatus can be used to clear the chimney flue simply by pulling cleaning head 10 up from its parked position illustrated in FIG. 1 to that of FIG. 2, breaking out the hot or partially burned, brittle, relatively fragile creosote and carry much, if not all of it, out of the chimney on the metal rod arrays. In fact, creosote can be removed in that way even as it burns.

In any such cleaning operation, the illustrated apparatus does not tend to clog and block smoke flow, the rods of the cleaning head rod arrays being so spaced that the almost vibrational lateral motion of the cleaning head as it is run up or down in a chimney serves to dislodge any creosote fragments which tend to hang up on the rods.

Figure 7:
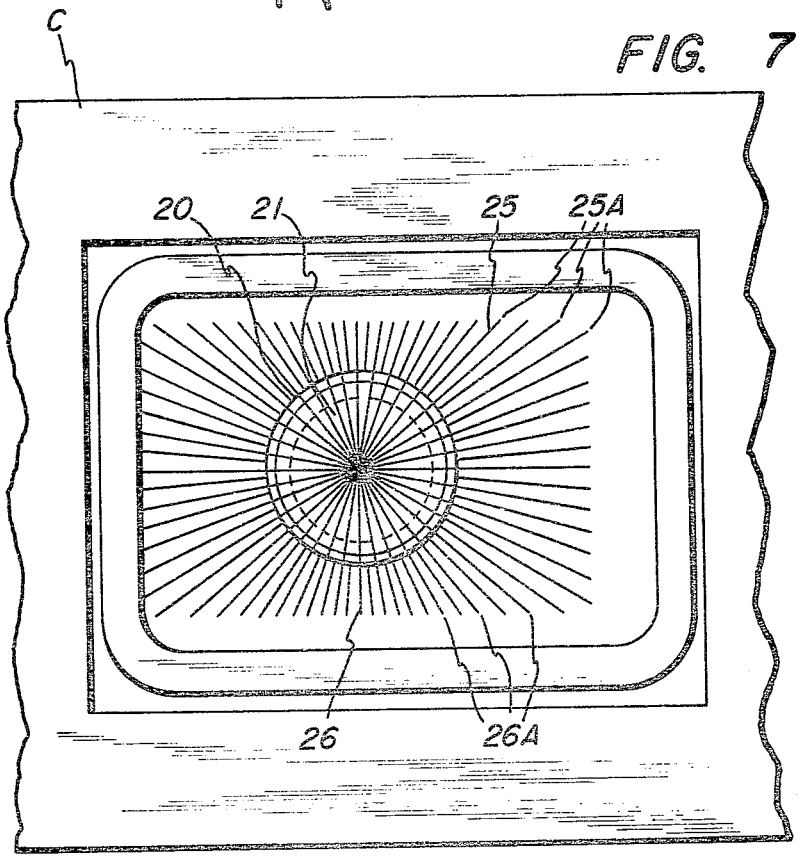
FIG. 7 is a fragmentary, top plan view of the FIG. 2 assembly with parts including the bail and supporting and operating means removed to show off axis suspension of cleaning head and the spacing of the rod ends from the chimney flue surface.
Figure 8:
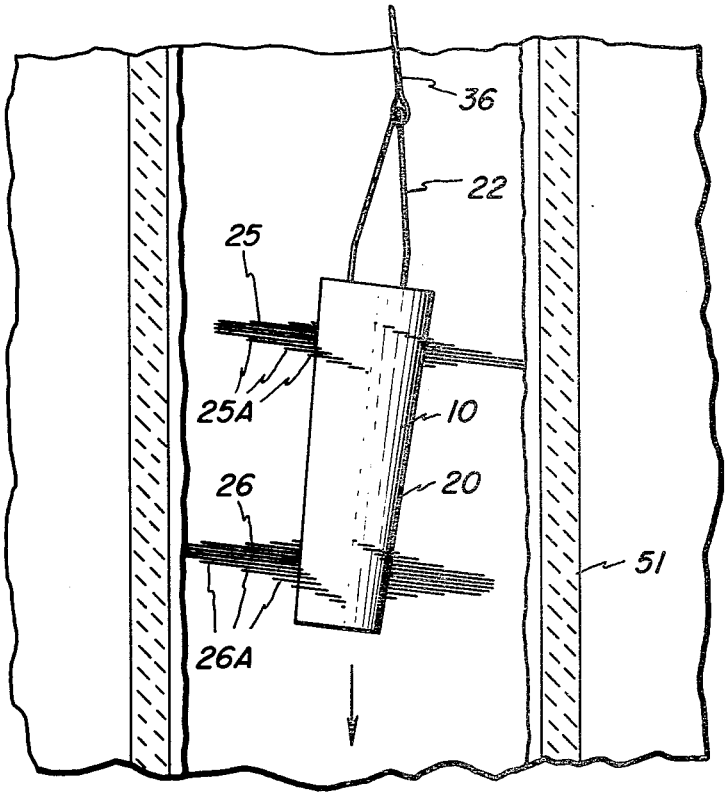
FIG. 8 is a vertical section view of a portion of the chimney of FIG. 1 showing the cleaning head of the present invention apparatus descending through the chimney in use in removing hard creosote deposit from the chimney flue surface.
Figure 9:
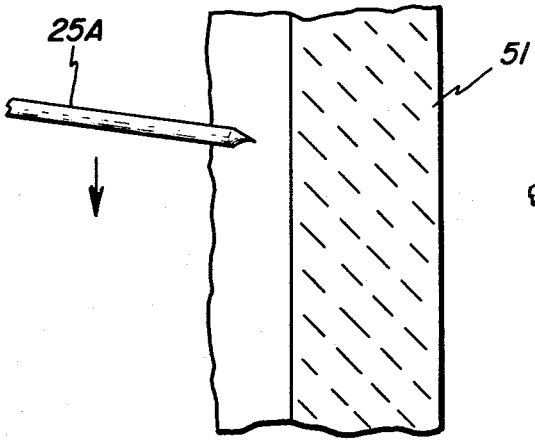
FIG. 9 is an enlarged, fragmentary, sectional view of the FIG. 8 assembly showing penetration of the sharp end of a metal rod of the cleaning head into the hard creosote deposit.
Figure 10:
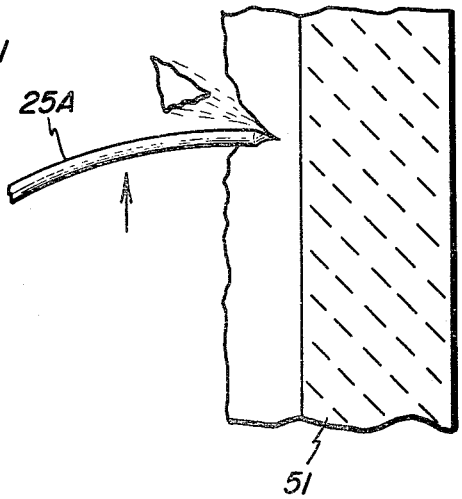
FIG. 10 is a view like that of FIG. 9 illustrating typical action of the embedded end of a metal rod in breaking and removing a piece of the hard creosote deposit as the cleaning head continues down the chimney.
Figure 11:
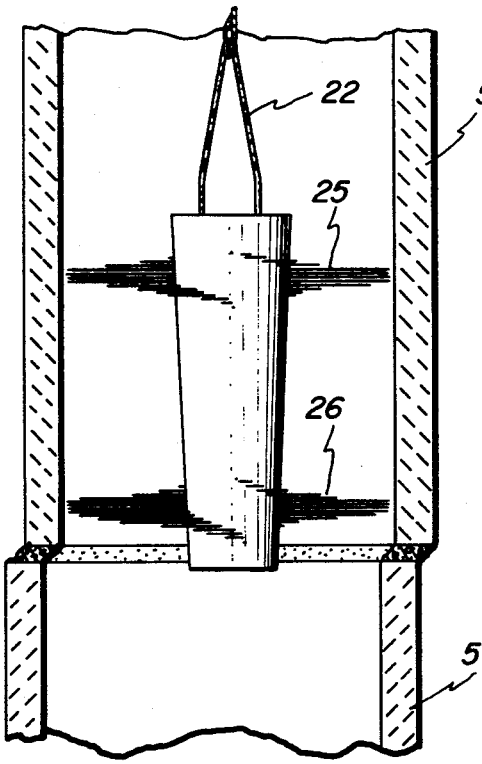
FIG. 11 is a fragmentary, vertical sectional view of a flue tile joint portion of a chimney in which a cleaning head of this invention is disposed.
Figure 12:
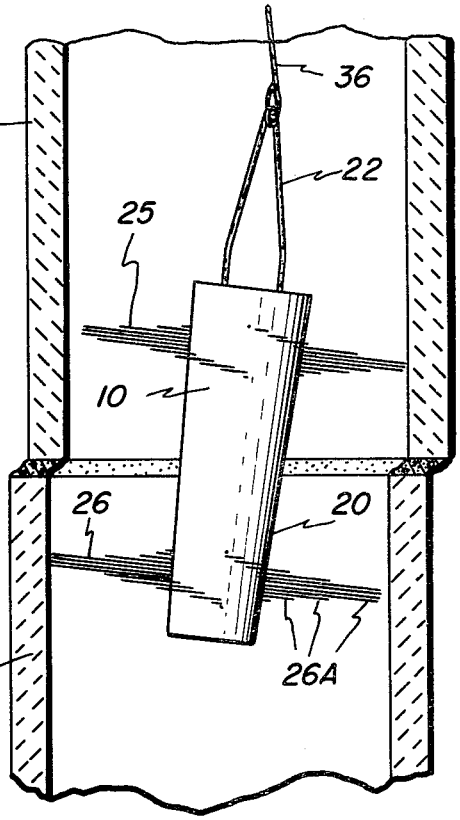
FIG. 12 is a view like that of FIG. 11 showing the manner in which the cleaning head easily traverses the offset tile joint in vertical travel in the chimney.
Figure 13:
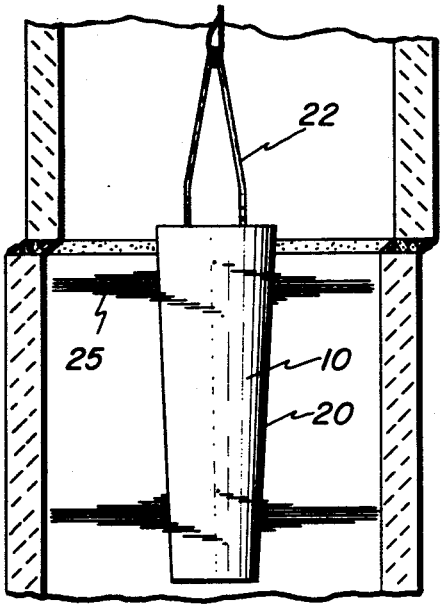
FIG. 13 is a view like that of FIGS. 11 and 12 showing the cleaning head back in normal attitude after having cleared the chimney tile joint.

The manner in which the method of this invention is carried out with the present novel apparatus is illustrated to special advantage in FIGS. 7, 8 and 9 in which hard creosote coating on the surface of chimney flue tile 51 is shown being subjected to the chipping action of cleaning head 10 moving downwardly in the flue by force of gravity. As explained above, a metal rod 26A of the lower rod array 26 strikes a part of creosote deposit, resulting in interruption of vertical travel of head 10 as it rocks into the position shown on FIG. 9, causing the end of rod 25A to strike against and penetrate creosote coating. Then, with the weight of head 10 bearing to substantial extent on rod 25A (as shown in FIG. 8), wedging action is imparted to the embedded end of the rod and as vertical motion of head 10 continues, a chip is broken away from coating (as shown on FIG. 10) and the head is deflected to the opposite side of the flue by the springing action of dislodging rod 25A and the head swings on bail 22 as its downward travel continues. It will be understood further that the events depicted in these three drawings normally occur in very short sequence and are repeated at relatively high frequency. Thus, continuous downward travel of the head is marked by horizontal motion oscillation of frequency dependent upon the downward travel rate, and the same condition obtains when the head is raised up through the flue. Consequently, hard creosote is removed continually in chip form in random manner as long as the cleaning head is run up and down a chimney flue having a hard creosote coating. As a practical matter, all traces of hard creosote do not need to be removed at any time from a chimney flue, and likewise, the hard creosote coating need not be removed to leave a final coating of uniform thickness and generally, a coating which is of variable thickness up to one-eight inch or even one-quarter inch will be satisfactory from the standpoint of the degree of risk of a destructive chimney fire. Frequent use of the present cleaning head, as every week or so, will be adequate in the usual case to maintain such condition.

Figure 5:
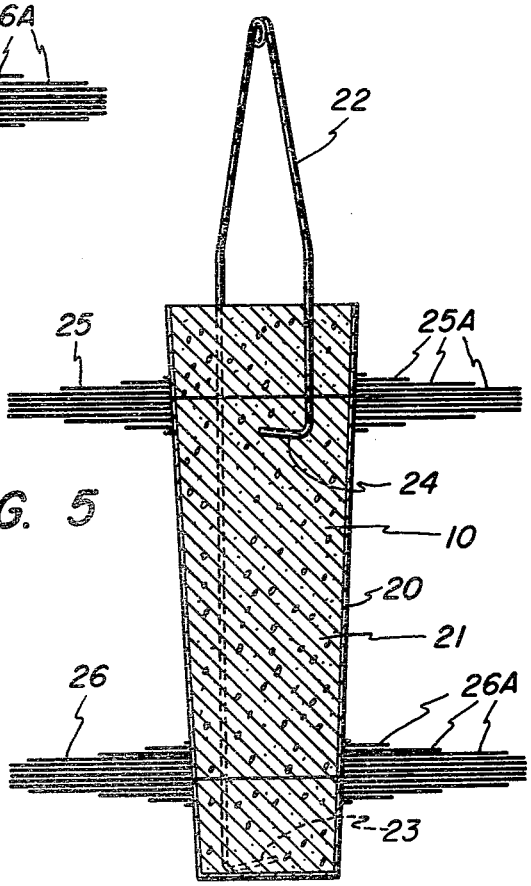
FIG. 5 is a vertical section view of the cleaning head of FIG. 4 illustrating the manner of attachment of the flexible bail to the cleaning head body and the disposition of the rods and the rod arrays radially and axially of the body.

A cleaning head of this invention such as head 10 in the drawings is fabricated in accordance with my preferred practice by forming frustroconical body 20 of 10-mil steel sheet about 12 inches long and of diameter about 3 inches at one end and 4 inches at the other. Diametrically registered pairs of apertures are provided in helical patterns near the ends of the body to receive rods 25A and 26A of 90-mil or 125-mil hardened steel wire to provide the rod arrays as shown in the drawings. Prior to assembling the rods with the body, or afterward if preferred, these metal parts and bail of 125-mil hardened steel wire are dipped in 20% hydrochloric acid solution for about 10 seconds and then bail 22 is assembled with one end 23 at the bottom of body 20 and the other end 24 bearing against the lowermost rod 25A, as shown in FIG. 5. Then body 20 is filled with a wet mixture 21 of Portland cement and sand.

After about one week at room temperature, the fill 21 is cured to required hardness and rods 25A and 26A are then cut to desired radial lengths by shears which produce a sharp, barbed end on each rod to promote rod penetration of the creosote deposit to be removed in the normal use of the device. This sizing of the cleaning head is done to insure the clearance essential to the hard creosote penetration and chipping action of this invention described above. Since chimney flues are produced generally in standard sizes and shapes, cleaning heads of this kind can be made in corresponding patterns and sizes on a mass production basis. For that special size or shape of flue to be cleaned with this new chimney cleaning device, the sizing of the head, particularly, in respect to the radial extensions of the rods, can be easily accomplished during final stages of manufacture. Additionally or alternatively, such trimming and sizing of the cleaning head may be done at the location where the head is to be installed and used so as to accommodate any special flue size or shape conditions.

It will be understood that cleaning heads made in this manner may be installed as illustrated in the drawings and used in accordance with the description above to limit the thickness of hard creosote coatings in chimney flues. It will also be understood, however, that the head may be otherwise used and operated to effect chimney cleaning and maintenance. Thus, while cleaning head 10 and its mounting and operating means are intended for use by an operator standing near the chimney base, the head can alternatively be used effectively by an operator at the top of the stack who manipulates it in the stack after the manner shown and described in that portion of my co-pending patent application, Ser. No. 282,968 filed July 13, 1981, now U.S. Pat. No. 4,408,368, which is incorporated herein by reference.

Figure 14:
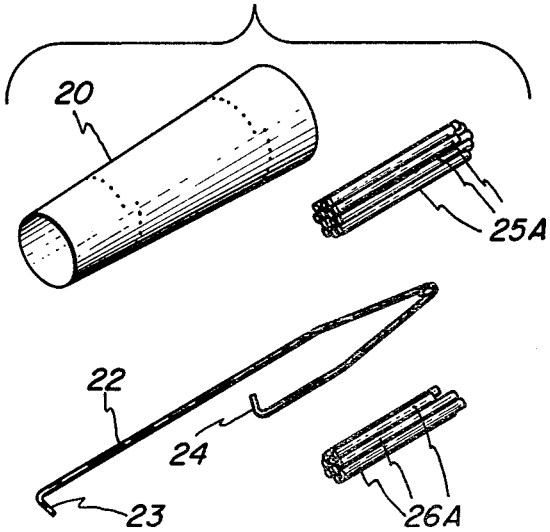
FIG. 14 is a view in perspective of an assembly, i.e., a kit, of the several components of a cleaning head of this invention in which the rods are in two bundles for incorporation with the body in two spaced arrays.

It will be further understood that, as indicated above and illustrated in FIG. 14, a cleaning head of this invention may be provided the ultimate user in the form of an assembly or kit of the several components of the head. Thus, the purchaser would put body 20 together with rods 25A and 26A and with bail 22 by the method described above. The component parts of the head are the body 20 and the rods 25A and 26A, preferably precut to approximate lengths for precise sizing after insertion through the pairs of registered apertures provided for that purpose in body 20. Cutting or shearing to provide sharp, barbed ends on the rods will preferably be done after assembly with body 20.

What is claimed:

1. Chimney flue cleaning apparatus for removal of hard creosote deposits including a cleaning head which comprises an elongated body, tapered from one end to the other, a plurality of metal rods fixed to the body and extending laterally therefrom for creosote deposit-penetrating impact and chip-producing effect, and (laterally) (flexible) suspension means (secured to) consisting of a laterally flexible bail having ends secured to the body and intermediate portions within the body and extending generally axially from the larger end of the tapered body.

2. The apparatus of claim 1 in which the metal rods are spaced apart axially of the body and extend through the body and have sharp barbed ends.

3. The apparatus of claim 1 in which the body is tapered and the metal rods extend through the body and are arranged in two separate helical pattern arrays near the ends of the body.

4. The apparatus of claim 3 in which the rods of each array are of 90-mil hardened steel wire and describe a generally rectangular pattern of cross section of substantially the same shape but smaller than the cross section of a flue to be cleaned by the apparatus.

5. The apparatus of claim 1 in which the body is a frustroconical metal shell filled with concrete and in which the rods are of a variety of different lengths and each rod extends diametrically through the body and projects substantially the same distance radially on each side of the body.

6. The apparatus of claim 5 in which the suspension means comprises a spring steel bail having its end portions embedded in the concrete of the body and having its intermediate portion extending from the larger end of the body for connection to lifting means.

7. The apparatus of claim 3 including a metal bail having end portions fixed to the body and an intermediate portion extending generally axially from the larger end portion of the body for attachment to a lifting cable.

8. The method of making chimney flue cleaning apparatus which comprises the steps of providing in a hollow frustro-conical body a plurality of radially aligned pairs of aperture in helical pattern, inserting a metal rod through each pair of registered aperture, substantially filling the body with concrete, and cutting the metal rods to desired lengths by shearing action producing sharp barbed ends on each said rod.

9. The method of claim 8 including the step prior to filling the body with concrete of positioning the ends of a metal bail in the body with the bail loop portion extending generally axially from the larger end of the metal body.

10. The method of claim 9 including the step of subjecting the rods and the bail to corrosive attack prior to assembly with the body to promote adherence between the metal parts and the concrete fill.

11. The apparatus of claim 1 including supporting and operating means comprising a cable connected to the tapered body of the cleaning head and sheave means including a sheave to run the cable and a bracket for attachment to a chimney to support the sheave above the upper end of a chimney flue to be cleaned by the apparatus.

12. The apparatus of claim 11 including adjustable bracket securing means for mounting the bracket in any of a variety of different positions on a chimney to be cleaned.

13. For use in constructing a chimney flue cleaning head effective to remove hard and brittle deposits of creosote in the form of relatively small chips, an assembly which comprises a hollow frustroconical body having two separate sets of radially aligned pairs of apertures arranged in helical pattern near the two ends of the body, a plurality of metal rods to provide two separate helical rod arrays near the ends of the body, each said rod being of cross section and length to extend through a pair of radially-aligned apertures to project radially from the body, and a spring steel bail having end portions to be received in and secured to the body and having an intermediate portion (to extend) within the body and extending generally axially from the larger end of the body for connection to means for lifting the assembled cleaning head.

* * * * *

UNITED STATES PATENT AND TRADEMARK OFFICE

CERTIFICATE OF CORRECTION

PATENT NO. 4,470,168

DATED : September 11, 1984

INVENTOR(S) : Donald P. Vickery

It is certified that error appears in the above-identified patent and that said Letters Patent is hereby corrected as shown below:

In column 8, lines 20-30, Claim 1 is corrected to read:

1. Chimney flue cleaning apparatus for removal of hard creosote deposits including a cleaning head which comprises an elongated body, tapered from one end to the other, a plurality of metal rods fixed to the body and extending laterally therefrom for creosote deposit-penetrating impact and chip-producing effect, and suspension means consisting of a laterally flexible bail having ends secured to the body and intermediate portions within the body and extending generally axially from the larger end of the tapered body.

Signed and Sealed this

*Twenty-sixth* Day of *February 1985*

[SEAL]

*Attest:*

DONALD J. QUIGG

*Attesting Officer* *Acting Commissioner of Patents and Trademarks*